United States Patent [19]

Murray et al.

[11] 4,010,096

[45] Mar. 1, 1977

[54] PNEUMATIC CLASSIFIER FOR REFUSE MATERIAL WITH ADJUSTABLE AIR INTAKE

[75] Inventors: Donald L. Murray, Greenfield; John N. Lees, Jr., Wauwatosa; Frank W. Toman, Jr., Milwaukee, all of Wis.

[73] Assignee: Allis-Chalmers Corporation, Milwaukee, Wis.

[22] Filed: Oct. 9, 1975

[21] Appl. No.: 621,225

[52] U.S. Cl. ..... 209/139 R; 209/149; 209/154

[51] Int. Cl.[2] ..... B07B 4/02; B07B 11/04

[58] Field of Search ..... 209/136–139 R, 209/140, 141, 149, 154, 26–29, 34–37

[56] References Cited

UNITED STATES PATENTS

| | | | |
|---|---|---|---|
| 1,791,673 | 2/1931 | Karlson et al. | 209/139 R |
| 2,696,910 | 12/1954 | Ljungdell et al. | 209/139 R |
| 3,618,761 | 11/1971 | Francis et al. | 209/139 R X |
| 3,655,043 | 4/1972 | Wochnowski et al. | 209/154 X |

FOREIGN PATENTS OR APPLICATIONS

| | | | |
|---|---|---|---|
| 862,966 | 3/1941 | France | 209/139 R |
| 737,223 | 9/1955 | United Kingdom | 209/135 |

*Primary Examiner*—Frank W. Lutter
*Assistant Examiner*—Ralph J. Hill
*Attorney, Agent, or Firm*—Arthur M. Streich

[57] ABSTRACT

An apparatus and operation is disclosed in which light solid material such as shredded paper passes from an upper end of a column and heavier material such as glass and metal particles drop from a lower end of the column. The column includes an air locked feed chute having a downwardly inclined material feeding surface, that opens intermediate the column ends into a stream of air moving upwardly in the column, for admitting mixed light and heavy solid particles of refuse material to the air stream. The column beneath the discharge end of the chute has vertical walls defining a rectangular air intake zone. The vertical wall opposite to and facing the chute is pivotally hung from an inclined member which is in turn pivotally supported by the column so this pivotally hung wall can move toward and away from the chute while remaining vertical. Adjustable support means are connected to the movable wall and position the wall and inclined member so the inner surface of the inclined member faces both downwardly and toward the chute. Movement of the movable wall toward or away from the chute therefore adjusts the angle of the inclined member and the angle at which upwardly moving air is turned toward the chute. The movable wall comprises an upper and a lower section that in part overlap and with the lower section having a lower horizontal edge defining a lip of an entrance to the air intake zone. Means are provided to clamp the two sections of the movable wall together with the lip in a selected vertically disposed position relative to the other vertical walls that cooperate with the movable wall to define the air intake zone.

2 Claims, 4 Drawing Figures

PNEUMATIC CLASSIFIER FOR REFUSE MATERIAL WITH ADJUSTABLE AIR INTAKE

BACKGROUND OF THE INVENTION

1. FIELD OF THE INVENTION

This invention relates to a pneumatic apparatus for classifying particles of refuse material and the like, to separate relatively light and heavy solid particles. In particular, this invention relates to a column classifier through which air is drawn from bottom to top and which has a feed chute that opens into the column intermediate the top and bottom, for admitting mixed light and heavy solid particles to the rising air stream, with the heavier particles dropping from the column while lighter particles are carried upwardly in the air stream.

2. DESCRIPTION OF THE PRIOR ART

Pneumatic devices for classifying and separating solid particles in an apparatus that a column with a stream of air rising therethrough, are known to the prior art. To facilitate describing the distinguishing features of the present invention from the prior devices, such prior devices can be categorized as comprising two types. A first type includes a column in which mixed solid particles are dropped into the top of the column in which a stream of air is rising; and a second type includes a column in which mixed solid particles are fed at an intermediate elevation into the column in which air is rising.

Examples of apparatus of the first type appear in U.S. Pat. Nos. 1,465,884 of Aug. 21, 1923; 1,650,727 of Nov. 29, 1927; 1,787,759 of Jan. 6, 1931; and 3,833,117 of Sept. 3, 1974.

Examples of the second type appear in U.S. Pat. Nos. 2,968,400 of Jan. 17, 1961; 3,265,210 of Aug. 9, 1966; and 3,441,131 of Apr. 29, 1969.

As will appear from the description to follow, the present invention relates to the aforesaid second type. The present invention has for its object the control of the velocity and flow pattern of an air stream into which mixed size and weight particles of refuse are admitted for classification and separation to provide an improved control effect upon separation characteristics in that type of classifier-separator. In such regard, it should be noted that among the prior patents referred to, there is a disclosure of a column with a wall that is movable to vary the horizontal cross-sectional area of the column and as a result thereof provides adjustable velocity of air flow through the column. That is, U.S. Pat. No. 3,441,131, in FIGS. 10–12, discloses a vertical wall structure supported by bolt shanks movable in horizontal slots, to vary cross-sectional area and air flow velocity. In addition, applicants are aware that devices of the aforesaid second type have been built with a pivotally supported vertical wall swingable about a horizontal axis toward and away from a facing wall to vary the cross-sectional area therebetween. However, such a swinging motion elevates or lowers the lower-edge lip of the swinging wall relative to adjacent walls and changes the flow pattern of air drawn into the column.

None of the aforesaid practices of the prior art have involved a wall pivotal about a horizontal axis that is carried by an adjustably inclined member having an inner surface facing both downwardly and toward a feed inlet chute, to adjustably turn an upwardly moving air stream moving in a tortuous path, in a manner that will be described with regard to the present invention.

SUMMARY OF THE INVENTION

It has hereinbefore been stated that the present invention relates to a type of classifier-separator in which mixed solid particles are fed through a chute at an intermediate elevation, into a column in which air is rising and that the object of the present invention involves the control of the velocity and flow pattern of the air stream to provide an improved control effect upon particle separation characteristics which results in relatively heavy solid particles dropping through the column and relatively light solid particles being carried upwardly and out of the column in the air stream. More specifically, the present invention relates to such an apparatus in which the column beneath the chute has vertical walls defining an air intake zone rectangular in horizontal cross-section and with at least one of such walls being pivotally hung from an inclinable member which is in turn pivotal about a horizontal axis and faces both downwardly and toward the feed chute. The movable wall can, therefore, move toward and away from an opposite wall of the intake zone to vary the cross-sectional area of the intake zone, to change the angle of the inclined member, to also change the angle through which the air is turned toward the chute, and the velocity of an air stream passing therethrough.

According to a preferred embodiment of the present invention, such a movable wall is the wall opposite to and facing the chute, and has upper and lower sections at least partly overlapping each other. The lower of these two sections has a lower horizontal edge which defines a lip of an entrance to the air intake zone. This lip, and lips defined by the lower edges of each of the other walls which together define the air intake zone, are each turned outwardly and upwardly to provide for a smooth flow of air into the intake zone. A guiding and holding means is provided to engage and hold the two sections of the movable wall together and position the lip of the lower section in any selected vertically disposed position relative to the other walls that cooperate with the movable wall to define the air intake zone. For example, after swinging the movable wall in a direction that lowers the lip of the movable wall, the lower section of the movable wall may be moved upwardly relative to the upper section to reposition the lip of the movable wall to be in a common horizontal plane with the lips of the other walls defining the air intake zone. The guiding and holding means may be such as a threaded stud connected to one of the movable wall sections with the stud projecting through a vertically disposed slot extending through the other of the movable wall sections, and having a nut turned on the projecting end of the stud to clamp the two sections of the movable wall together with the lip of the lower section in a selected vertical position relative to the other walls of the air intake zone.

Other features and objects of the invention that have been attained will appear from the more detailed description to follow with reference to an embodiment of the present invention shown in the accompanying drawing.

DESCRIPTION OF THE PREFERRED EMBODIMENT

Figure 1:
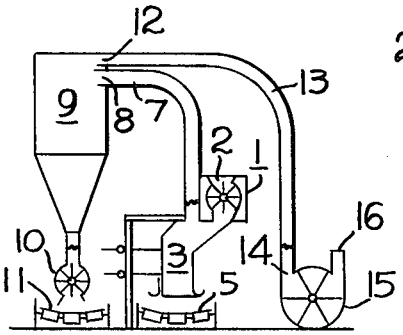
FIG. 1 of the accompanying drawing shows diagrammatically an arrangement of a system including a side elevation, partly in section, a classifier-separator according to the present invention.

Referring to FIG. 1 of the drawing, a system arrangement is shown in which an apparatus according to the present invention may be used for classifying particles of refuse material and the like to separate relatively light and relatively heavy solid particles. FIG. 1 discloses a classifier-separator 1 having an inlet 2 for admitting mixed light and heavy solid particles to a column 3. A lower air entrance end 4 of column 3 is open for drawing air into column 3 and dropping heavier solid particles from column 3 to a coveyor 5. An upper end 6 of column 3 is connected by a conduit 7 to an inlet 8 of a cyclone separator 9. The cyclone separator 9 may be of the usual design and construction in which air and entrained light solid particles are admitted tangentially to the separator and directed in a cyclonic path during which the particles are thrown outwardly by centrifugal force and drop down to a star wheel discharging device 10 which discharges the light solid particles to a conveyor 11. Air from which the light solid particles have been thusly removed, passes out through an outlet 12 and through a conduit 13 to an inlet 14 of a blower 15. Blower 15 draws air through the system, with the air entering the lower end 4 of column 3 and passing through column 3, conduit 7, cyclone separator 9, conduit 13 to blower 15 from which the clean air is discharged through an outlet 16 to atmosphere.

Figure 2:
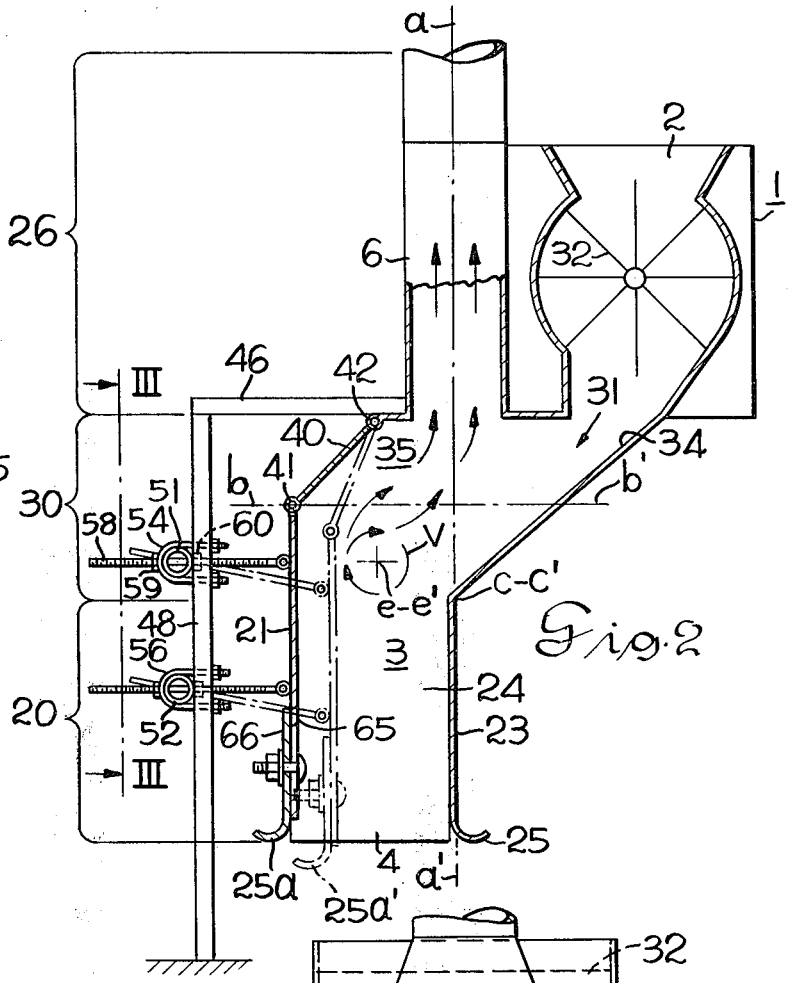
FIG. 2 is a side elevation, in section, of the classifier-separator to enlarged scale.
Figure 4:
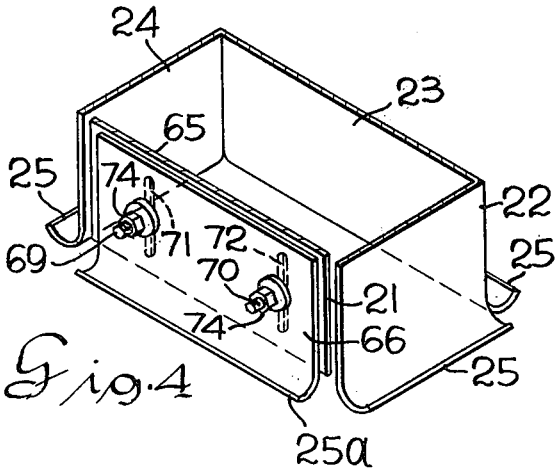
FIG. 4 is a fragmentary isometric view of a portion of the apparatus.

The construction and operation of the classifier-separator 1 will now be described in detail with reference to FIGS. 2, 3 and 4. As shown in FIG. 2, the column 3 comprises a lower rectangular air intake zone portion 20 made up of walls 21–24 which define the air entrance 4, and the lower edges of the walls 22–24 have outwardly and upwardly curved lips 25 to provide a smooth flow of air into the air intake zone 20 (a similar lip 25*a* on wall 21 will be hereinafter described). An upper column portion 26 comprises a transition piece 6 which on its upper end defined the column outlet end, and which is arranged with a central vertical axis a—a′ (FIG. 2) therethrough located in the vertical plane of wall 23 of the air intake zone 20.

Between the lower portion 20 and the upper portion 26 is a midportion 30 which will now be described with reference to FIG. 2. At the level of the midportion 30, a chute 31 is arranged in communication with the material inlet 2 and opens into midportion 30. An air lock feeder 32 which may be driven by such as an electric motor 33 mounted as shown in FIG. 3, is provided between the material inlet 2 and the upper end of chute 31, as shown in FIG. 2. The chute 31 is itself provided with a downwardly inclined material feeding surface 34 from the air lock feeder 32 to the midportion 30 of column 3, with a downward slope that defines an angle of preferably about 120° with wall 23. The surface 34 intersects with wall 23 along a horizontal axis c—c′. The chute 31 and its surface 34 thus cooperate with wall surfaces projecting upwardly from the air intake zone 20 of column 3 to define a zone 35 of expanded column volume within the midportion 30, with the expanded volume zone 35 having a cross-sectional area at the level of a horizontal plane b—b′ that is greater than adjacent zones defined within the portions 26 and 20, which are respectively above and below the expanded zone in midportion 30.

The vertical wall 21, opposite to and facing chute 31, is constructed and supported to be movable toward (as indicated by phantom lines in FIG. 2) and away from chute 31, while the wall 21 remains vertical to vary the horizontal cross-sectional area of zone 10 and thus the velocity of air drawn therethrough. This is accomplished by the vertical wall 21 being hung from an inclinable member 40 by a horizontally extending pivotal connection 41, while the member 40 is in turn hung from the column 3 by a horizontally extending pivotal connection 42. Thus the inclinable member 40 pivots about connection 42 with the connection 41 swinging in an arcuate path from the position shown in FIG. 2 by solid lines, to the position shown in FIG. 2 by phantom lines while the wall 21 pivots directly about connection 41 and pivots relatively about connection 42. Wall 21 can, therefore, maintain its vertical position while being moved from the position shown in FIG. 2 by solid lines to the position shown in FIG. 2 by phantom lines.

Figure 3:
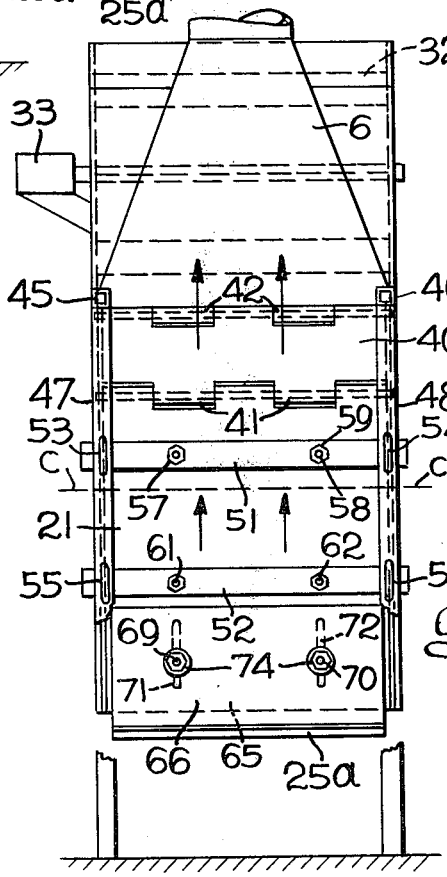
FIG. 3 is a view taken along line III—III in FIG. 2 and viewing the structure in the direction indicated by arrows.

In order to support the wall 21 and actuate the aforesaid movement, a pair of beams 45, 56 (both are shown in FIG. 3 but only beam 56 is shown in FIG. 2) are connected on one end to column 3 while the opposite ends of the beams 45, 56 are each carried by a column 47, 48, respectively, (both columns 47, 48 are shown in FIG. 3 but only column 48 is shown in FIG. 2). A pair of pipes 51, 52 are arranged vertically spaced apart to horizontally span the space between columns 47, 48. A pair of generally C-shaped holders 53, 54 encompass pipe 51, with holder 53 being connected to column 47 and holder 54 being connected to column 48, to carry pipe 51 for rotation relative to columns 47 and 48. Similarly, a pair of generally C-shaped holders 55, 56 encompass pipe 52, with holder 55 being connected to column 47 and holder 56 being connected to column 48, to carry pipe 52 for rotation relative to columns 47 and 48. A pair of threaded rods 57, 58 horizontally spaced apart, as shown in FIG. 3, are pivotally attached to wall 21, as shown in FIG. 2, and project through pipe 51. A pair of nuts 59, 60 are turned on rod 58, with one on each side of pipe 51. The rod 57 may similarly pass through and be connected to pipe 52. By turning such nuts 59, 60 the rods 57, 58, 61 and 62 may be moved through their respective pipes 51, 52 to move wall 21 from the position shown in FIG. 2 by solid lines to the position shown by phantom lines. Since such movement of wall 21 results in swinging wall 21 downwardly, the rods 57, 58, 61, 62 will turn pipes 51, 52 within their C-shaped holders 53–56 in a clockwise direction when viewed as in FIG. 2.

The movable wall 21, according to the present invention, comprises an upper section 65 and a lower section 66. The sections 65, 66 overlap one with the other, with section 66 preferably outward of section 65, as best shown in FIG. 2 and FIG. 4. With continued reference to FIG. 2 and FIG. 4, the lower wall section 66 has an outwardly and upwardly curved lip 25*a* which cooperates with the previously described lip 25 to define the entrance 4 to the air intake zone 20. A suitable guiding and holding means will now be described for engaging and holding the two wall sections 65, 66 together and to position the lip 25a in any selected vertically disposed position relative to the other walls 22–24 that cooperate with the movable wall sections 65, 66 to define the air intake zone 20. Such means may comprise a pair of threaded studs 69, 70 connected to the lower wall section 66, and which project outwardly through a pair of vertically disposed slots 71, 72 extending through upper wall section 65. A nut 74 may be turned on the outwardly projecting end of each stud 69, 70 and tightened to clamp together the two sections 65, 66 of movable wall 21 with the lip **25*a* in a selected vertical position relative to the other walls 22–24 of the air intake zone 20.**

In the operation of the described system and apparatus according to the present invention, fan 15 (in FIG. 1) draws air through conduit 13, cyclone 9, conduit 7, column 3 and hence atmospheric air into the lower end 4 of column 3. Mixed size particles of such a refuse material enter inlet 2 and are fed by the air lock feeder 32 into chute 31. Such material slides and tumbles down the surface 34 of chute 31 and into the air stream rising through the column 3. Some of the heavier particles drop immediately onto conveyor 5 while other particles are carried upwardly in the rising air stream. Such air and entrained particles reach the expanded zone 35 defined by the midportion 30 of column 3 and chute 31. At this level, the air stream turns toward the chute 31 because of reduced resistance to air flow by the substantial expansion of the enclosed volume. That is, it is the chute 31 that expands the enclosed volume at that level and so the air stream turns toward the chute. This movement combined with the orientation of the upper column portion 26, also toward the chute 31, results in the formation of a turbulence about a horizontal axis e—e′ before the air stream resumes its upward flow, as indicated by arrows in FIG. 2. Turning the nuts 59, 60 on each of the rods 57, 59, 61 and 62 to move wall 21 from the position shown in FIG. 2 by solid lines to the position shown with phantom lines will reduce the cross-sectional area of the air intake zone 20 and the air drawn therethrough by fan 15 will move at greater velocity. Such movement of wall 21 about the pivots 41 and 42 will lower the lip **25*a* to the position labeled 25*a*′ in FIG. 2. The nuts 74 may then be loosened and wall section 66 moved upwardly relative to wall section 65 with the threaded studs 69, 70 moving upwardly in slots 71, 72 and the lip 25a moves from the position 25*a*′ upwardly until lip 25a is again in a common horizontal plane with the lip 25. Such a repositioning of lip 25*a* to the horizontal plane of lips 25, or any other position above or below that position, may be tried until the desired change in separating characteristics, as determined by visually observing particle drop-out on conveyor 5, is achieved. Both the existence of the vortex V and a tubulence that is variable and controllable with attendant effect upon separation characteristics, by moving wall 21 (which necessarily changes the angle of the inclined member 40 as shown with phantom lines in FIG. 2) and section 66 of wall 21** in the manner described, have been confirmed by observing the path followed by bits of shredded paper and other observable solid particles in feed material fed to the apparatus as described.

Particles retained in the rising air stream as it passes from column 3 to the cyclone separator 9, drop from the air stream in separator 9 and are discharged through the star wheel 10 to conveyor 11 while the air stream which is now clean of refuse material passes through fan 15 to atmosphere.

From the foregoing detailed description of the present invention, it has been shown how the objects of the present invention have been attained in a preferred manner. However, modifications and equivalents of the disclosed concepts such as readily occur to those skilled in the art are intended to be included in the scope of this invention. Thus, the scope of the invention is intended to be limited only by the scope of the claims such as are or may hereafter be, appended hereto.

The embodiments of the invention in which an exclusive property or privilege is claimed are defined as follows:

1. An apparatus for classifying particles of refuse material and the like to separate relatively light and heavy solid particles and having a column, means connected to the upper end of the column for drawing a stream of air into the lower end of the column and upwardly through the column, a chute that opens into the column intermediate the column ends for admitting mixed light and heavy solid particles, the column beneath the discharge end of the chute having vertical walls defining an air intake zone rectangular in horizontal cross-section and with at least the vertical wall of the air intake zone opposite the chute being movable and pivotally connected along a horizontal upper edge to a lower edge of an incline member which is in turn pivotally supported by the column along an upper horizontal edge so that the movable wall can move toward and away from the opposite wall of the air intake zone with the movable wall remaining vertical, and including an improvement which comprises:

a. the chute having an air lock feeder and a downwardly inclined material feeding chute from the feeder to a midportion of the column where the chute opens into the column and cooperates with the column to define a zone of expanded volume having a horizontal cross-sectional area greater than the cross-sectional area of the column above and below the expanded zone, the vertical walls which define the air intake zone are arranged with one of such vertical walls opposite the movable wall intersecting with the material feeding surface of the chute along a horizontal axis of intersection, and with such one wall being in vertical alignment with a vertical center line through a portion of the column above the expanded zone, to thereby define for upwardly ascending air and particles a tortuous path with a turn toward the material feeding surface of the chute; and b. adjustable support means connected to the movable wall and adapted to position the movable wall to in turn position the inclined member with its inner surface facing both downwardly and toward the chute, whereby a movement of the movable wall toward or away from the chute adjusts the angle of the inclined member beneath which air and particles moving upwardly are turned toward the chute in the course of following said tortuous path.

2. An apparatus according to claim 1 in which:

a. the movable wall has upper and lower sections at least partly overlapping each other and with the lower section having a lower horizontal edge defining a lip of an entrance to the air intake zone; and b. a guiding and holding means connected to one of the sections of the movable wall and arranged to engage and hold the other of the movable wall sections to position the lip of the lower section in selected vertically disposed positions relative to the other vertical walls that cooperate with the movable wall to define the air intake zone.

* * * * *